United States Patent [19]

Greek, Jr. et al.

[11] 3,998,311

[45] Dec. 21, 1976

[54] INDICATING ENTRY INTO A VARIABLE WIDTH RIGHT MARGIN ZONE

[75] Inventors: John Charlie Greek, Jr.; Howard Carl Tanner, both of Austin, Tex.

[73] Assignee: International Business Machines Corporation, Armonk, N.Y.

[22] Filed: Jan. 17, 1975

[21] Appl. No.: 541,754

[52] U.S. Cl. ..... 197/19; 197/84 A; 197/176; 197/187; 340/172.5

[51] Int. Cl.[2] ..... B41J 19/64; B41J 21/00

[58] Field of Search ..... 197/19, 20, 176, 180, 197/84 A, 84 R, 187; 340/172.5; 234/1, 4

[56] References Cited

UNITED STATES PATENTS

| | | | |
|---|---|---|---|
| 2,913,096 | 11/1959 | Boling | 197/187 |
| 2,968,383 | 1/1961 | Higonnet et al. | 197/20 |
| 3,209,901 | 10/1965 | Krause et al. | 197/84 R |
| 3,270,854 | 9/1966 | Baker | 197/187 |
| 3,631,957 | 1/1972 | Terry | 197/84 A |
| 3,757,921 | 9/1973 | Bishop | 197/84 A |
| 3,805,940 | 4/1974 | Stockham | 197/20 |

*Primary Examiner*—Edgar S. Burr
*Assistant Examiner*—William Pieprz
*Attorney, Agent, or Firm*—James H. Barksdale, Jr.

[57] ABSTRACT

A system which utilizes a floating hot zone for controlling quality of ultimately justified output text. In preparing text for later justified output, the minimum space size is set at three units. The zone is variable in width and located within the measure and adjacent the right margin. The width of the zone is partially dependent upon the number of spaces on a line. During printing, the left side of the zone is tentatively established when the residue is equal to, or less than, 36 units. Then, when the residue is equal to, or less than, the number of spaces times nine, the system will cause a bell to ring. This will alert the operator that the zone has been entered and if printing is thereafter terminated, the maximum space size will not exceed 12 units during later justified output.

3 Claims, 8 Drawing Figures

INDICATING ENTRY INTO A VARIABLE WIDTH RIGHT MARGIN ZONE

BACKGROUND OF THE INVENTION

1. Field of the Invention

This invention relates generally to printing systems. More specifically, this invention relates to a system wherein a control or hot zone of floating width is utilized for preparing text such that desired quality is obtained upon later justification.

2. Description of the Prior Art

In the prior art there are any number of margin control systems as evidenced by U.S. Pat. Nos. 3,245,614; 3,483,527; 3,631,957; 3,676,853; and 3,757,921. Of these U.S. Pat. No. 3,245,614 is considered representative of the closest known prior art.

Portions of this patent relate to type composing wherein a determination is made as to the number of escapement units to be added to the spaces in order to justify a line. To begin with, character codes and space codes are generated in the consecutive order in which they are to appear in printed text. There is a measuring of the product of the spaces and a maximum expansion constant. The line deficit is determined by using a minimum expansion constant for each generated space. There is a continuous compare of the deficit with a function of the product until the function exceeds the deficit. Then, the generating of character and space codes is terminated. Thereafter, the characters and spaces are repeated with space expansion when necessary.

With the subject system there is no need for determining a function of a product, nor a continuous compare of a deficit with either the product or a function of the product. A comparison of the product only takes place after the residue is equal to, or less than, 36 units. In essence, this patent is really directed toward justification and how it is accomplished per se, rather than providing an operator with a zone indication denoting that printing can be terminated and a justification solution of high quality will result. That is, the subject patent is directed toward determining the amount of space expansion for justification rather than determining that a desired space size will not be exceeded on later justification.

The second mentioned patent above is directed toward hyphenation. The third patent is also directed toward hyphenation a well as the selection of the last space falling within a zone. The fourth patent relates to a control zone intermediate the left and right margins for automatically determining when line endings are to be preserved or lines are to be justified. The last mentioned patent above is directed toward the elimination of hyphenation decisions through forcing the last space to fall within the zone.

SUMMARY OF THE INVENTION

A system is provided having a keyboard and printer, a buffer and control, and margin zone control structure. During either an input operation from the keyboard, or an output operation where codes are read from the buffer, it is necessary to alert the operator when sufficient characters and spaces have been printed to calculate an acceptable justification solution upon later output. Once the operator has been provided with this indication, either playout from the buffer or input keying can be terminated. With printing beginning at the left margin, the escapement units for the characters and spaces printed are tabulated. When the residue is equal to, or less than, 36 units, the first condition for defining the floating hot zone of this right hand margin control system has been determined. Then when the residue is equal to, or less than, the number of spaces times nine, the second condition will be met and a bell ring or other suitable indication thereof will be transmitted to the operator. The most important application of this invention as related to an input keying operation is to alert the operator to begin looking for a space or an acceptable hyphenation location before the right margin is reached. For adjust during an entry playout operation, if a space is detected after the ringing of the bell a carrier return is automatically initiated and the carrier is returned to the left margin and indexed for the next line. For either operation, the space size will not exceed 12 units if the line is terminated within the zone. Should a space not be detected in the zone during entry playout, then the carrier will be backed up to the beginning of the word and the printer will stop. Thereafter, the operator must key character-by-character to determine an appropriate hyphenation decision. In the event hyphenation is not desired and a carrier return is inserted by the operator at a space location prior to the zone, then the space size will exceed 12 units during later justification. The operator will have been alerted though.

DESCRIPTION OF THE PREFERRED EMBODIMENT

Generalized System Description

Figure 1:
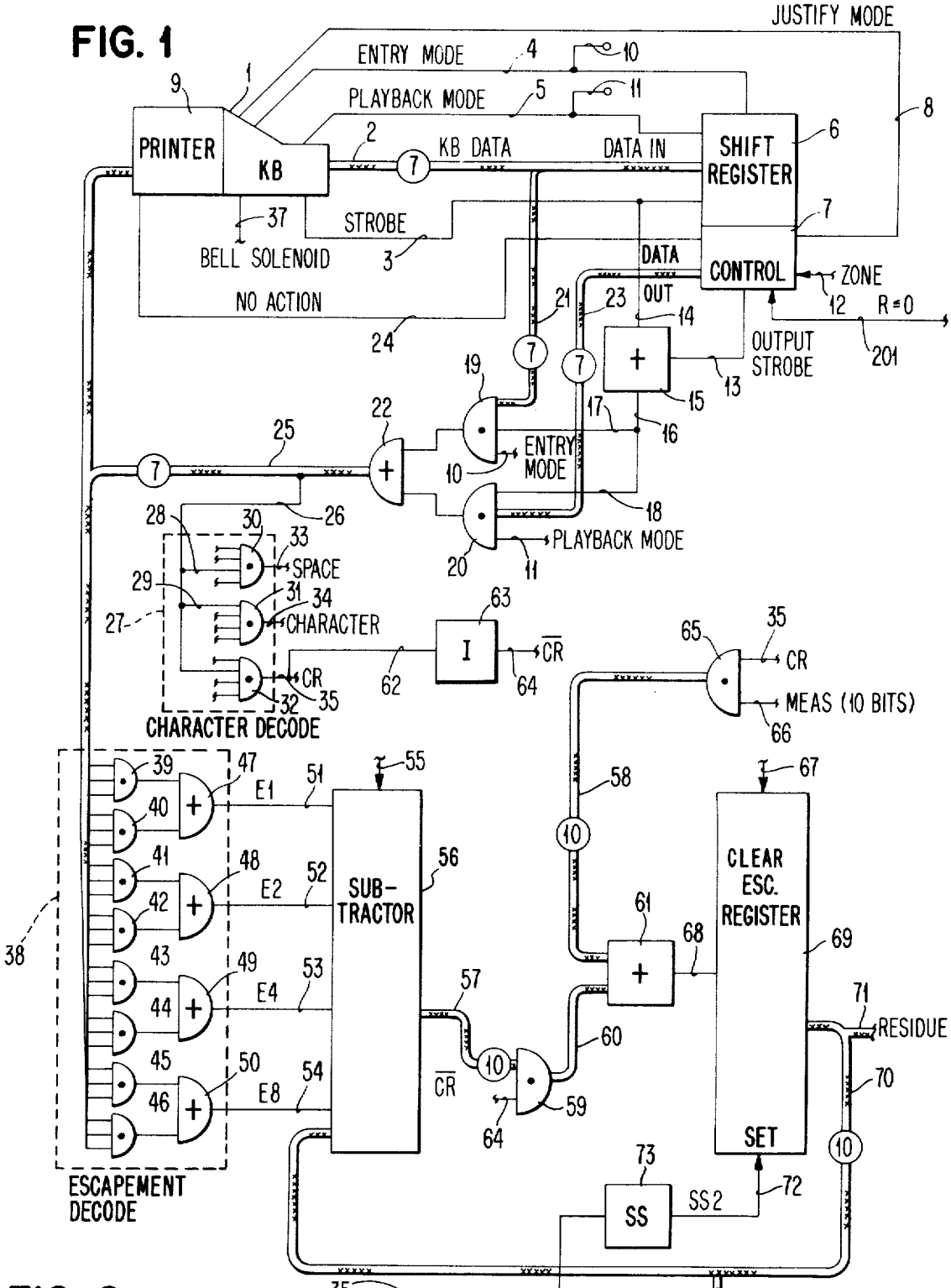
FIG. 1 is an overall block diagram illustrating a printer and keyboard, buffer and control, and associated structure making up the right hand margin control system of this invention.

For more detailed description of the invention, reference is first made to FIG. 1. In this figure are shown a keyboard 1, a printer 9, buffer or shift register 6, and control 7. Data to be printed by printer 9 is derived either from keyboard 1 or shift register 6. That is, during input keying an operator will key data on keyboard 1 which will be printed by printer 9. During entry playout of data from shift register 6, the data again will be printed by printer 9. Entry playout or playback generally involves a revision operation where data is printed out in a non-justified format and adjusted.

There are three distinct operations involving printing with the subject system. One is input or entry keying where characters and spaces are printed by printer 9 and stored in shift register 6 as each is keyed on keyboard 1. For this operation an entry mode key will be manipulated by the operator. Another is entry playout where characters and spaces are read out of shift register 6 and printed by printer 9. During entry playout, revision operations such as insertion and deletion of characters and spaces are performed on the keyboard 1. Thereafter, the text remaining following the revision is adjusted. For example, if during entry playout a word is to be inserted into a line, playout is stopped at the point of revision. The operator then keys in the word and causes playout from shift register 6 to continue.

Since the insertion of the word has extended the length of the line, an adjust operation is in order. For this operation a playback mode key will be manipulated by the operator. The remaining operation is final copy playout where, for example, the text is to be justified. For this operation, the lines of text have already been prepared and stored during entry keying and/or entry playout. Each line is scanned, a justification solution is calculated, and then the line is printed out in final copy form with any necessary space expansion. For this operation an operator will key both a justify mode and a playback mode.

In terms of interword space sizes upon final copy playout, high quality composition is provided if the space sizes fall within specified ranges. For purposes herein a range between three and 12 escapement units is considered desirable. Correspondingly for a particular print font, an *m* would require nine escapement units, an *a* would require five escapement units, an *i* would require three escapement units, etc.

The maximum width of the automatically variable, or floating, hot zone of this invention is 36 units for purposes herein. This is not to say that a line cannot be terminated more than 36 units from the right margin. If a line (not being a widow line) is terminated more than 36 units from the right margin, then, depending upon the number of spaces on the line, the size of each space may exceed 12 units during justification (final copy) playout. A widow line is normally defined by a double or required carrier return. If the widow line ends within the zone then it will be justified. If a widow line ends before the zone, then its line ending is preserved during final copy playout.

During either entry keying or entry playout, it may occur that there is no suitable line ending such as a space within the zone. In this case a hyphenation decision is made by the operator, and keyed and stored along with a carrier return.

It is important to note that the margin control, or hot, zone of this invention floats for each line. Since, from the above, the maximum width of the zone is 36 units, when the residue is equal to, or less than, 36 units, the first condition for defining the zone has been determined. The second condition for defining the zone is determined when the residue is equal to, or less than, the product of the number of spaces and nine. When the first condition is met and there are four spaces, then the zone is 36 units wide.

Reference herein to signals, inputs, outputs, etc. are to be taken as one, positive, or up conditions unless otherwise noted. Further, although reference is made to a signal or line, it is to be appreciated that where weighted and data signals are concerned there are a plurality of signals applied along a plurality of lines or a buss. Busses are represented on the drawing by double lines and the number of lines making up the busses are circled on the busses.

When data is keyed on keyboard 1 during input keying it is output along the data buss 2 to shift register 6. As each character is keyed, a timing signal is also output along strobe line 3 to shift register 6. That is, for each character keyed by an operator a signal is applied along the strobe line 3 and seven bits of data representing a character byte are applied along data buss 2. Other outputs from keyboard 1 include mode signals such as justify applied along line 8, entry applied along line 4 and playback applied along line 5. The outputs along lines 4 and 5 are applied to shift register 6. Shift register 6 has an included control 7, and both taken as a whole can be considered equivalent to the buffer and control described in U.S. Pat. Nos. 3,675,216 and 3,755,784, and U.S. patent application Ser. No. 427,184. The entry mode, playback mode and jusification mode are entered by an operator keying on keyboard 1. Further, shift register 6 can be an electronic dynamic shift register, a random access memory, a magnetic card, magnetic tape, or any other suitable storage device. When a random access memory is used it will have an included address register and counter. When magnetic cards and tapes are utilized as storage devices, a read/write head and address control will be used for inputting and outputting data. With the signal applied along entry mode line 4 to shift register 6, control 7 is conditioned for the storage of characters keyed on keyboard 1. For purposes of clarity, both shift register 6 and control 7 will hereinafter be referred to only as shift register 6. The playback mode control signal applied along line 5 is also applied to the shift register 6. Outputs in the form of character codes are derived from shift register 6. Also input to shift register 6 is a zone signal along line 12 and an R less than, or equal to, zero signal along line 201. Output from shift register 6 is an output strobe signal applied along line 13 or OR gate 15. The other input to OR gate 15 is the keyboard strobe signal applied along lines 3 and 14. The output of OR gate 15 is applied along lines 16 and 17 to AND gate 19, and along lines 16 and 18 to AND gate 20. Gates 19, 20, and 22 are each representative of seven parallel gates which are used to gate information on either buss 2 or buss 23 onto buss 25. Another input to AND gate 19 is the entry mode signal applied along lines 4 and 10. The remaining input to AND gate 19 is along the data buss 2 and 21. When in the playback mode where data is to be printed by printer 9 from the contents of shift register 6, signals are applied along the data out buss 23 to AND gate 20. The information applied along the data out buss 23 will be gated through AND gate 20 and to OR gate 22 when a signal is applied along the playback mode lines 5 and 11 to AND gate 20. The output of AND gate 19 is also applied to OR gate 22. The output of OR gate 22 is along buss 25. The output of OR gate 22 is also applied along lines 26, 28, and 29 to character decode 27. Character decode 27 can be considered as being made up of AND gates 30, 31 and 32. When a positive input is applied along line 28 to AND gate 30 a space signal will be applied along line 33. When a positive input is applied along line 29 to AND gate 31 a character signal will be applied along line 34. When a positive signal is applied along line 26 to AND gate 32 a carrier return signal will be applied along line 35. The output along line 35 is also applied along line 62 to inverter 63 with the output being applied along the NOT carrier return line 64. Buss 25 is also connected to escapement decode 38 which is structured similar to character decode 27. Escapement decode 38 is pictorially represented as being made up of two tiers of AND gates 39–46 and 47-50. The outputs from escapement decode 38 are applied along lines 51–54 to subtract unit or subtractor 56. Once data is output from OR gate 22 the operation of the remainder of the system is essentially the same whether in the entry or playback mode. That is, in the entry mode the characters which are applied to the character decode 27 and the escapement decode 38 along line or buss 25 are those characters being keyed by the operator. In the playback mode the characters applied along line 25 to decodes 27 and 38 are those characters being printed by the printer 9 and applied to the printer 9 from the shift register 6. The outputs along lines 51–54 are binarily weighted to represent the escapement of the character input along line 25 to decode 38. If, for example, the character A appeared on the seven lines at the output of OR gate 22 and the character A were to have a five unit escapement, then the output lines E1 and E4 would be up or true. The other two output lines E2 and E8 would be zero or down. Therefore, for each character keyed and printed in the entry mode or printed in the playback mode, the outputs of escapement decode 38 will be a binarily weighted escapement value. Having above set out a brief generalized system description, a more detailed description will follow as related to the operation of the system.

OPERATION

Operation can begin when, for example, a carrier return is keyed. In this case a carrier return code is gated through AND gate 19, through OR gate 22 and along buss 25 to character decode 27. The output of character decode 27 will be a signal along line 35. This signal is also applied to OR gate 75 and then along line 74 to single shot 73. The output of single shot 73 is an SS2 signal applied along line 72 for setting escapement register 69. A NOT carrier return signal is applied along line 64 to AND gate 59. This will disenable the gating of the output of subtractor 56 along line 57 through AND gate 59 and along line 60. Only when a positive signal is applied along line 64 will the contents applied along line 57 be gated through AND gate 59. The carrier return signal applied along line 35 is also applied to AND gate 65. The other input to AND gate 65 is the measure applied along line 66. Therefore, upon the application of a carrier return signal and the measure to AND gate 65, the measure is gated along line 58, through OR gate 61, and along line 68 into escapement register 69. The measure applied along line 66 is derived from the structure illustrated in FIG. 5. That is, the measure is output from latch register 134 along line 66. This signal is in actuality binarily weighted bits and represents the line length to which the operator has determined that the text is to be set. The measure is defined as the distance in units between the left and right margins. As far as the inputs to latch register 134 are concerned, these will be discussed later in the specification. It is to be appreciated that gates 59, 61, and 65 are representative of 10 parallel gates.

A binarily weighted output from escapement register 69 is applied along line or buss 70 to subtractor 56. The carrier return signal applied along line 35 is also applied along the reset line to binary counter 83 shown in FIG. 3; resetting this counter to zero. The output of counter 83 is along buss 84 which represents a number of spaces.

Figure 3:
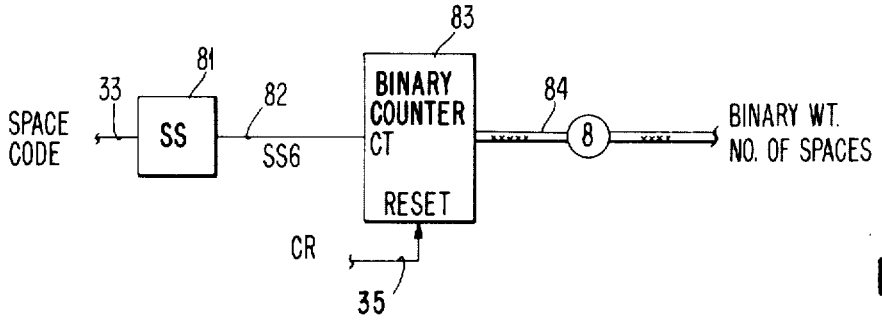

When a space is detected and decoded by character decode 27 in FIG. 1, an output is applied along space code line 33 to single shot 81 in FIG. 3. The output of single shot 81 is along the SS6 line 82 to binary counter 83. Binary counter 83 is structured to count the number of spaces from the left margin and is reset to zero upon a carrier return. Further, the carrier return signal applied along line 35 in FIG. 1 is applied to OR gate 95 in FIG. 4 and then along line 96 to latch 89. Line 96 is the reset line for latch 89. When latch 89 is reset a NOT check zone signal is applied along line 97.

Figure 8:
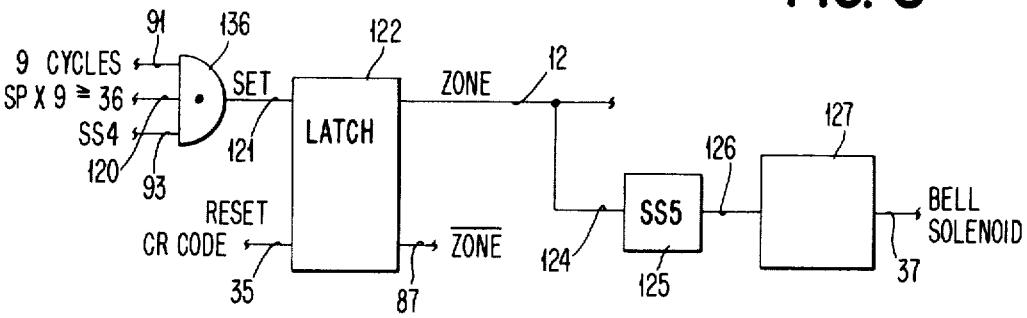

The carrier return code applied along line 35 in FIG. 1 is also applied along the reset line to latch 122 in FIG. 8. The NOT output of latch 122 applied along the NOT zone line 87.

Figure 4:
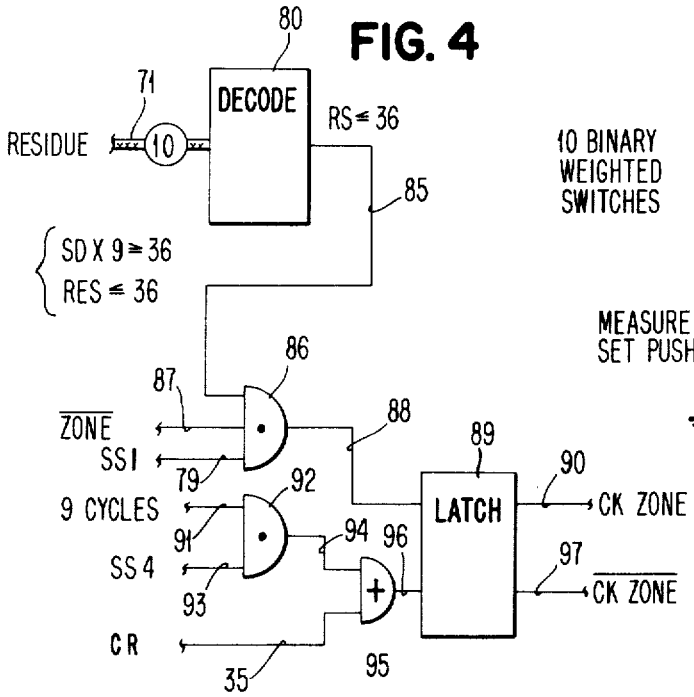
Figure 7:
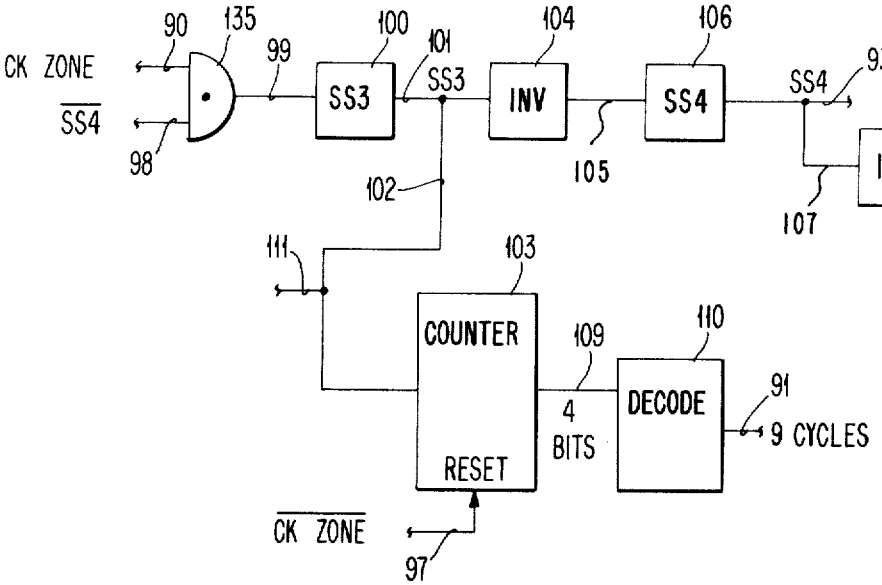

The NOT check zone output of latch 89 in FIG. 4 along line 97 is applied along the reset line to counter 103 in FIG. 7 for resetting it to zero. Therefore, upon a carrier return the conditions are that the escapement register 69 is loaded wih the measure, the output of latch 89 is NOT check zone along line 97, the output of latch 122 is NOT zone along line 87, counter 83 is reset to zero, and counter 103 is reset to zero.

1. Printing From Left Margin

It is now to be assumed that the carrier of printer 1 is positioned at the left margin and an operator has keyed a print character. In this case the character will be applied along line 25 to character decode 27. The output of decode 27 will be applied along line 34. Also, the binary value of the escapement for the character will be output along a number of lines 51–54 to subtractor 56. The weight of the character keyed is then subtracted from the measure which is input to the subtractor from escapement register 69 along line 70. Subtracter 56 can be an arithmetic logic unit made up of three commercially available units (SN 74181) marketed by Texas Instruments, Inc. Further, the arithmetic logic unit can be wired to permenently be in a subtract mode by connecting the appropriate inputs to ground or high voltage levels. This is represented by a subtract mode line 55 which has no source since it is permanently wired. Therefore, the output of subtractor 56 along line 57 is always the residue, and after the first character has been keyed will be equal to the measure minus the number of units for the keyed character.

At this time the NOT carrier return signal applied along line 64 has come up permitting the contents of subtractor 56 to be gated along line 57, through ANd gate 59, and along line 60. The character output from character decode 27 is also applied along line 34 to OR gate 75, and then along line 74 to single shot 73. Single shot 73 then fires and an SS2 signal is applied along line 72 to escapement register 69 for setting escapement register 69. Thus the new value which is the residue minus the escapement of the character is now stored in escapement register 69. This operation repeats for each character keyed with the residue value continuously being updated (lowered) for each character. When a space is printed due to either operator keying or the output of data from the shift register 6, the output from decode 27 will be along line 33. The output from escapement decode when the space is applied along line 25 to escapement decode 38 will be a binary value which is a minimum space value. In this case it is to be assumed that the minimum space value is three units. The space signal applied along line 33 is also applied to OR gate 75 and along line 74 to single shot 73. The output of single shot 73 is an SS2 signal along the set line 72 to escapement register 69. The output of subtractor 56 along line 57 and through AND gate 59 will be the binary difference of the previous residue and the escapement for the space. As pointed out above, this is assumed to be three units. Also since the signal NOT carrier return along line 64 is up, the binary difference from subtractor 56 is applied along line 57, through AND gate 59, along line 60, through OR gate 61, and along line 68 to escapement register 69. This binary difference will be set into escapement register 69 upon the firing of single shot 73 and the application of an SS2 signal applied along line 72. Therefore, when a space is printed, the residue is decremented by the minimum escapement of three units for the space. Also the space code output along line 33 is applied to single shot 81 in FIG. 3. When single shot 81 fires, an SS6 signal is applied along line 82 to counter 83 for incrementing the count of the spaces. That is, upon the printing of the space, counter 83 is incremented by one. Although above reference has been made to the printing of characters and spaces, it is also to be appreciated that reference could easily have been made to the keying on keyboard 1 or the reading out of the spaces and characters from shift register 6. As mentioned earlier, the binary counter 83 was reset to zero at the beginning of the line due to a carrier return at the end of the return at the end of the previous line.

2. First Condition

The above operation proceeds as described for each character and space that is keyed on keyboard 1 or is read out of shift register 6, and printed. The residue diminishes for each character and space according to the preassigned escapement value for each character and space.

Figure 2:
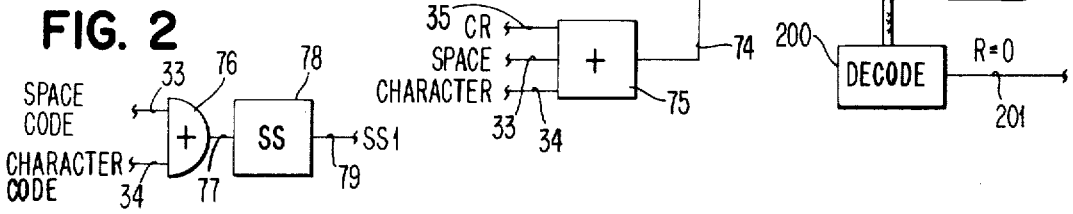
FIGS. 2–8 illustrate additional portions of the structure making up part of the right hand margin control system of this invention.

The output of escapement register 69 along line 70 is also applied along line 71. This residue is applied to decode 80 in FIG. 4. Decode 80 will eventually provide an output along the "R is less than, or equal to, 36" line 85 when the residue is reduced to a binary value of 36 or less units. The output of decode 80 applied along line 85 is applied to AND gate 86. The second input to AND gate 86 is a NOT zone signal applied along line 87. This is derived from latch 122 in FIG. 8. The third input to AND gate 86 is an SS1 signal applied along line 79. This is derived from single shot 78 in FIG. 2. With all the inputs to AND gate 86 being true, a signal is applied along line 88 for setting latch 89. When latch 89 is set a check zone output is applied along line 90. The SS1 input to AND gate 86 along line 79 results from either a space applied along line 33, or a character applied along line 34, to OR gate 76. The output of OR gate 76 is along line 77 to single shot 78. When single shot 78 fires an SS1 signal is applied along line 79. Single shot 78 fires for each space or character.

The zone latch 122 in FIG. 8 will not be set without first the check zone signal being applied along line 90 in FIG. 4. Therefore, the first condition that must be satisfied in order to indicate the entering of the zone is that the residue must be equal to, or less than, 36 units. This is necessary for the setting of the check zone latch 89 for applying a check zone signal along line 90. When the check zone latch 89 is set, then the second condition can be determined.

3. Check Zone Sequence

From the above, the check zone latch 89 can be set upon the occurrence of either a space signal or a character signal applied along lines 33 or 34. When a signal is applied along line 90 in FIG. 4, it is also applied to AND gate 135 in FIG. 7. With the signal $\overline{SS4}$ applied along line 98, a signal is gated through AND gate 135 and along line 99 to single shot 100. The output of single shot 100 upon the firing thereof is an SS3 signal applied along lines 101, 102, and 111. The signal applied along lines 101 and 102 upon the firing of single shot 100 is applied to counter 103 for incrementing it. When single shot 100 fires, a signal is also applied along line 101 to inverter 104. The output of inverter 104 will be down along line 105. This down output is applied to single shot 106 allowing it to restore. When single shot 100 drops, single shot 106 will fire and SS4 Signal is applied along line 93. This signal is also applied along 107 to inverter 108. The output of inverter 108 is $\overline{SS4}$ signal applied along line 98. This $\overline{SS4}$ is fed back to AND gate 135. From the above, when single shot 106 fires, single shot 100 will restore. As long as a check zone signal is applied along line 90, single shots 100 and 106 will alternately fire.

Each time single shot 100 fires a signal is applied along lines 101 and 102 to increment counter 103. The output of counter 103 is along line 109 to decode 110. When counter 103 has been incremented to nine, a nine cycles output will be applied along line 91. The nine cycles output along line 91 is applied to AND gate 92 in FIG. 4. The $\overline{SS4}$ output from single shot 106 along line 93 in FIG. 7 is also applied to AND gate 92. A signal is then gated along line 94, through OR gate 95, and along the reset line 96 to latch 89. The output of latch 89 will now be along the NOT check zone line 97. The nine cycles output from decode 110 along line 91 will be used to effect the multiplication of the number of spaces by nine as will be described below. The nine cycles output from decode 110 along line 91 is also applied to AND gate 136 in FIG. 8. The output from single shot 106 along the SS4 line 93 is also applied to AND gate 136. The other input to AND gate 136 is along the 11 number of spaces times nine greater than, or equal to, 36 units 11 line 120. An output will be applied along the set line 121 to latch 122 when the number of spaces times nine is greater than, or equal to, 36. When latch 122 is set, a zone signal will be applied along line 12. The nine units used herein is the maximum addition to each space which will meet the quality criteria of a maximum space size of 12 units upon justification.

Figure 6:
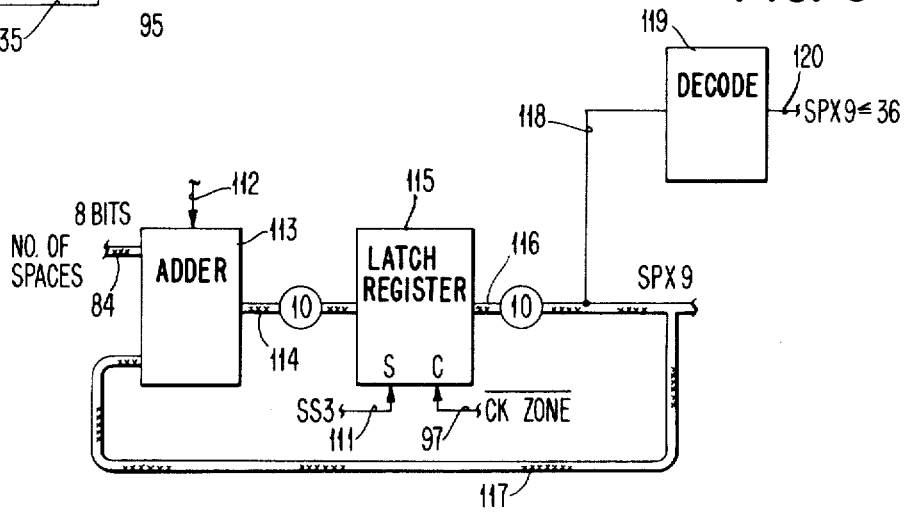

Referring now to both FIGS. 3 and 6, the output of the number of spaces along line 84 is applied to adder 113. Also, the output of latch register 115 along lines 116 and 117 is also applied to adder 113. Latch register 115 receives a NOT check zone input along the clear line 97. Therefore, previous to every check zone signal, latch register 115 is cleared. As described with reference to FIG. 7, each time a signal is applied along the check zone line 90 in FIG. 4, a series of nine single shot SS3 pulses or signals will be output from single shot 100. These pulses are applied to the set line 111 of latch register 115 in FIG. 6. This will effect the addition of the number of spaces to itself nine times. For example, assume the number of spaces has a binary value of two. Then, before the first SS3 signal is applied along line 101, the latch register 115 will have an output binary value of 0. The sum at the output of adder 113 will be two. Thus on the first SS3 signal applied along line 101, a value of two will be entered into latch register 115. On the second SS3 signal applied along line 101 and line 111 the sum of four will appear at the output of adder 113. This is because it will have an input value of two at each of its inputs. Therefore, the number four will be entered into latch register 115. On the third SS3 pulse applied along line 111, the sum at the output of adder 113 will be six, since two will remain at the number of spaces input and the value four is applied at the other input. Therefore, the value six will enter latch register 115. This is repeated nine times for causing the ninth SS3 pulse on line 111 to have a value stored multiplied by nine. The output of latch register 115 along line 116 is also applied along line 118 to decode 119. When the contents of latch register 115 or the "number of spaces times nine is greater than, or equal to 36," an output from decoder 119 will be applied along line 120.

4. Operation — Not Zone

From the above, when two ordered conditions are met an operator will be alerted that further printing will be in the zone. The first condition is that the residue is equal to, or less than, 36 units. The second condition is that the residue is equal to, or less than, the number of spaces times nine.

With a character appearing on buss 25 and the residue being less than 36 units, latch 89 in FIG. 4 is set and a check zone signal is applied along line 90. Also, a sequence of nine pulses are output from single shot 100 in FIG. 7 along the SS3 line 101. These nine pulses are used to multiple the number of spaces by nine. At the conclusion of the ninth pulse, the latch register 115 in FIG. 6 will contain this multiplied value, and the output of decode 119 along line 120 will either be up or down. In the event that it is down (and the number of spaces times nine is not equal to or greater than 36) the second condition mentioned above has not been met. In either case, the ninth pulse causes the output of decode 110 in FIG. 7 to be nine cycles along line 91. This output is applied to AND gate 92 in FIG. 4, along line 94, through OR gate 95, and along the reset line 96 to latch 89. The output of latch 89 will then be along the NOT check zone line 97 to latch register 115 in FIG. 6 for clearing register 115. The NOT check zone signal is also applied along line 97 to reset counter 103 in FIG. 7. If the second condition mentioned above is not met, a check will be made upon the next character appearing on buss 25. The above described sequence continues on every character appearing on line 25 until the residue is reduced to below, or equal to, 36 units.

5. Operation — Zone Indication

It is to now be assumed that a character appears on buss 25 which causes the carrier to be positioned such that the second condition is met. In this case the output of latch 89 in FIG. 4 will be along the check zone line 90. Also, nine pulses will be output from signal shots 100 and 106 in FIG. 7 as described above. On the ninth pulse from single shot 100, latch register 115 in FIG. 6 will have a "space times nine" output along line 116. The output from decode 119 will be "space times nine greater than, or equal to, 36 units" along line 120. The output of nine cycles along line 91 from decode 110 in FIG. 7 is applied to AND gate 136 in FIG. 8. Since the other two inputs to AND gate 136 along lines 93 and 120 are up, a signal will be gated along line 121 for setting latch 122. When latch 122 is set, a zone signal will be applied along lines 12 and 124 to single shot 125. This will cause signal shot 125 to fire and a signal to be applied along line 126 to magnet driver 127. The output of magnet driver 127 is applied along the bell solenoid line 37 to keyboard 1 in FIG. 1. This will cause a bell to ring, alerting the operator that the two conditions have been met. Also the output applied along line 12, indicating that the carrier has entered the zone, is applied to shift register 6. This is for purposes of looking for an acceptable line ending such as a following space to end the line and force a carrier return. Once the zone has been indicated, then there are a sufficient number of spaces as related to the residue such that no space will be expanded more than nine units and be larger than 12 units for justification purposes.

6. Measure Setup

Figure 5:
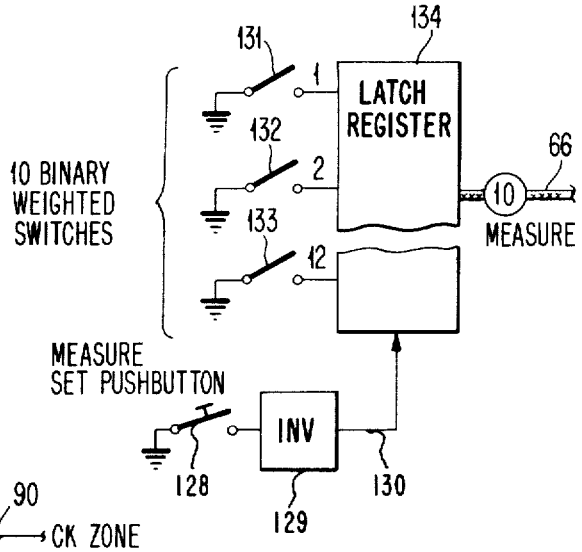

As mentioned earlier, the measure is set by the operator at the beginning of a job. This can be accomplished through setting a dial or keying. A number of binary weighted switches 131–133 pictorially represented in FIG. 5 are set for the desired measure. These switches are connected to latch register 134. The measure is set into latch register 134 by an operator manipulating a measure set pushbutton 128. When button 128 is depressed, the output of inverter 129 will be along the set line 130 to latch register 134.

A widow line indicated by, for example, a double carrier return on output printing will be determined during a scan of the contents of shift register 6. The characters are output as though printing were in progress except the control 7 will cause a signal to be applied along the "no action" line 24 to printer 9 for inhibiting printing of the characters The output strobe along line 13 is driven for each character. Following the character which precedes the carrier return on the widow line, the control 7 would sample the zone input applied along line 12. If this input were up, space expansion would be in order since the line can be acceptably expanded. If the zone signal along line 12 were down, then there would be no space expansion.

7. Revision

During entry playout, and revision a space or carrier return may fall within the zone. The residue can decrement to less than, or equal to, zero units. In this case, the residue applied along line 70 is also applied along decode 200, and an output is applied along the "residue less than, or equal to, zero units" line 201. The output applied along line 201 for this condition is applied to control 7 for causing the printer 1 to stop and the return of the printer carrier to the beginning of the last word. The operator then will make a hyphenation decision.

In summary, a right hand margin control system utilizing a floating hot zone is provided for improving quality of justified text. An indication determined by two ordered conditions is provided the operator to insure that if printing ceases thereafter, and before the right margin, the desired quality in terms of expansion will be maintained. The first condition is that the residue is equal to, or less than, 36 units. The second condition is that the residue is equal to, or less than, the number of spaces times nine.

While the invention has been particularly shown and described wih reference to a particular embodiment, it will be understood by those skilled in the art that various changes in form and detail may be made without departing from the spirit and scope of the invention.

What is claimed is:

1. A system for indicating entry into a variable width zone adjacent a right margin, said system comprising a. means for storing an operator selected measure count;

b. means for tabulating a running count of escapement units for characters and spaces with a minimum number of escapement units being tabulated for each space;

c. means for tabulating a running count of said spaces;

d. means for comparing said escapement unit count with said measure count to determine a residue count;

e. means for calculating a product of said space count and a space expansion constant; and f. means for indicating entry into said zone defined by:

A. said residue count being equal to, or less than, a predetermined number of escapement units, and B. said residue count being equal to, or less than, said product.

2. A system according to claim 1 wherein said predetermined number of escapement units is a product of a selected number of spaces and said space expansion constant.

3. A method of determining an acceptable ending for a line of characters and spaces for improving appearance quality of said line when ultimately justified, said method comprising:

a. establishing a measure count;

b. tabulating a running count of escapement units for said characters and spaces with a minimum number of escapement units being tabulated for each space;

c. tabulating a running count of said spaces;

d. comparing said escapement unit count with said measure count to determine a measure residue; and e. indicating when said measure residue is A. equal to, or less than, a predetermined number of escapement units, and B. equal to, or less than, a product of a space count and a space expansion constant.

* * * * *